United States Patent [19]

Chu

[11] 4,439,964

[45] Apr. 3, 1984

[54] INTERIOR STORM WINDOW

[76] Inventor: Young Y. Chu, 59-28 Forty-first Ave., Woodside, N.Y. 11377

[21] Appl. No.: 458,219

[22] Filed: Jan. 14, 1983

[51] Int. Cl.[3] ..... E06B 3/64; E06B 3/28

[52] U.S. Cl. ..... 52/202

[58] Field of Search ..... 52/202, 203

[56] References Cited

U.S. PATENT DOCUMENTS

| | | | |
|---|---|---|---|
| 2,046,362 | 7/1936 | Baldwin | 52/203 |
| 2,098,127 | 11/1937 | Auger | 52/203 |
| 2,111,343 | 3/1938 | Walz | 52/203 |
| 2,212,726 | 8/1940 | Atwood | 52/203 X |
| 2,275,812 | 3/1942 | Woelfel | 52/203 X |
| 3,971,178 | 7/1976 | Mazzoni et al. | 52/202 X |
| 4,194,331 | 3/1980 | Gingle et al. | 52/203 |

FOREIGN PATENT DOCUMENTS

| | | | |
|---|---|---|---|
| 2420870 | 11/1975 | Fed. Rep. of Germany | 52/203 |
| 1262407 | 2/1972 | United Kingdom | 52/202 |
| 2044334 | 10/1980 | United Kingdom | 52/203 |

*Primary Examiner*—J. Karl Bell

*Attorney, Agent, or Firm*—Lowe, King, Price & Becker

[57] ABSTRACT

An interior insulator apparatus for doors, windows, and other thermal openings includes mounting strips having two oppositely disposed adhesive surfaces for adhesively mounting an insulating sheet to a structure. A flexible support for the mounting strips permits premounting and assembly of the strips thereto, to simplify installation by the user. The flexible support is folded to provide the adhesive mounting of the insulator, and further to provide a seal around the periphery of the insulator.

18 Claims, 6 Drawing Figures

INTERIOR STORM WINDOW

BACKGROUND OF THE INVENTION

This invention relates to insulating structures, and more specifically to insulating structures for application to interior surfaces in a dwelling for covering windows and the like to prevent passage of drafts and heat therethrough.

The use of dead airspace for thermal insulation and for the prevention of passage of drafts is known in the prior art. For example, it is well known to utilize storm windows and sotrm doors to provide such dead airspace adjacent windows and doors of a dwelling. It is similarly known to utilize sheets of plastic at the interior surface of a window, or other opening, to provide such dead airspace in an inexpensive manner.

For example, there is available in the marketplace a structure for application to windows, doors and vents which includes a frame and a 4 mil vinyl sheet. The device provides a channel portion for a frame, the channel portion including an adhesive surface for bonding to a wall, a window or door frame or sash, or the like. The vinyl sheet is retained within the channel member by a plastic retainer strip. Such structures, however, are expensive to manufacture and are difficult to manipulate.

Another device available on the marketplace supplies sheets of 1¼ mil flexible plastic along with framing strips and nails for application to interior or exterior surfaces. This device is similarly difficult to apply and to mount.

Still another prior art frost shield is described in Walz U.S. Pat. No. 2,111,343. The patent describes a shield plate, which is preferably made of glass, and a slitted four-sided strip of compressable elastic material such as sponge rubber, having two of its opposing faces covered with tacky adhesive, for adhering to a windshield at one face and to the glass shield plate at the other. The strip attaches the shield to the window and provides a seal therebetween. While such an arrangement utilizes advantageously a strip having two adhesive sides, it is apparent that the shield plate is bonded to the mounting structure at only a single surface thereof, and may thus become dislodged therefrom.

There is accordingly a need in the prior art to provide a simple, inexpensive, easily manufactured and secured mounting structure for insulating sheets to be applied to windows, doors and other openings or sources of heat exchange between an interior and an exterior of a home, dwelling or other structure.

SUMMARY OF THE INVENTION

Accordingly, it is a primary object of the present invention to overcome the difficulties of the prior art and to provide an inexpensive, easily manufactured and easily applied insulating structure.

It is a more specific object of the invention to provide an easily applied support structure for an insulating sheet to be applied to a window, door, or the like.

It is a further object of the invention to provide a mounting frame for an insulating sheet, the frame incorporating a number of mounting strips having two adhesive surfaces.

A more particular object of the invention is the provision of a mounting frame having at least two doubly adhesive mounting strips for attaching and insulating sheet to a stable structure adjacent a window, door, vent or the like.

It is still a further object of the invention to provide an insulating structure including a mounting frame having three two-sided, doubly adhesive mounting strips, to enable secure mounting of an insulating sheet to the structure.

Still a more specific object of the invention is the provision of an insulating structure including a mounting frame having four two-sided mounting strips for providing a secure mounting of an insulating sheet to a stable structure, and for permitting a second insulating sheet to be mounted thereto.

Additional objects, advantages and novel features of the invention will be set forth in part in the description of the invention and in part will become apparent to those skilled in the art from practice of the invention.

To achieve the foregoing and other objects, and in accordance with the purpose of the present invention as embodied and broadly described herein, an insulating structure according to the invention includes a mounting frame for attachment of an insulating sheet to a stable structure adjacent a thermal opening. The mounting frame includes first and second adhesive mounting strips, at least one strip having two oppositely disposed adhesive surfaces. The first mounting strip is used for mounting the frame to the stable structure, and the second mounting strip mounts a portion of one surface of the insulating sheet to the stable structure.

Preferably, the first strip adheres along one of its adhesive surfaces to the table structure, and along its other adhesive surface to a flexible support. Moreover, the second strip is preferably arranged for adhering along one of its adhesive surfaces to the other side of the flexible support, and for adhering along the other adhesive surface to the insulating sheet.

A third mounting strip, having two oppositely disposed adhesive surfaces, may also be provided in the mounting frame. The third strip is mounted along one of its surfaces to the opposite surface of the insulating sheet. The third strip is preferably adhesively bonded along its other surface to the second surface of the flexible support means, thus "sandwiching" the insulating sheet between the second and third sheets.

In accordance with further aspects of the invention, a support structure for interior insulators includes first, second and third mounting means. The first mounting means is used to mount the support structure to a stable structure, the second mounting means attachably mounts a portion of one surface of an interior insulator to the stable structure, and the third mounting means attaches to a corresponding portion of an opposing surface of the interior insulator for enhancing the attachment thereof to the second mounting means.

A fourth mounting means may be attached to the third mounting means for mounting yet a second interior insulator thereto.

Yet another aspect of the invention provides a method for installing an interior insulator to a structure, where the insulator includes an insulating sheet and a mounting frame therefor. The inventive method includes the step of adhesively bonding first surfaces of first and second mounting strips to first and second opposite surfaces of a flexible support in the mounting frame. A second surface of the first mounting strip is adhesively bonded to a stable structure, and a first surface of the insulating sheet is adhesivley bonded to a second surface of the second mounting strip.

Preferably, the inventive method includes a further step of adhesively bonding a first surface of yet a third mounting strip to the second surface of the flexible support, and adhesively bonding a second surface of the third mounting strip to a second surface of the insulating sheet. By folding the flexible support to achieve the desired bonding, a dead airspace is created around the periphery of the insulator and a seal is formed thereby for the insulator. A fourth mounting strip may be provided and the inventive method may include a step of adhesively bonding a first surface thereof to the first surface of the flexible support. An additional insulator may be mounted to the second surface of the fourth mounting strip.

Still other objects, features and advantages of the present invention will become more readily apparent to those skilled in the art from the following description wherein there is shown and described a preferred embodiment of the invention, simply by way of illustration of one of the best modes contemplated for carrying out the invention. As will be realized, the invention is capable of other embodiments and its details are capable of modifications in various obvious aspects, all without departing from the invention. Accordingly, the following description and drawings will be regarded as illustrative in nature and not as restrictive of the invention.

BRIEF DESCRIPTION OF THE DRAWINGS

The accompanying drawings, incorporated in and forming a part of the specification, illustrate several aspects of the present invention and, together with the description, serve to explain the principles of the invention. In the drawings.

DETAILED DESCRIPTION OF THE INVENTION

Figure 1:
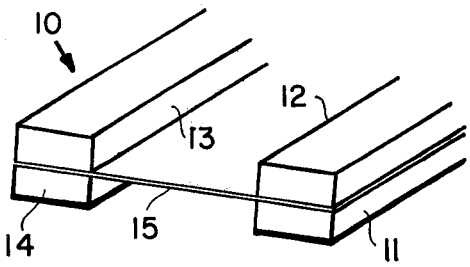
FIG. 1 shows a perspective view of a mounting frame structure for supporting an insulating sheet in accordance with the present invention.

Reference is now made to FIG. 1 showing a mounting frame structure for an insulating sheet in accordance with the present invention.

As shown therein, a mounting frame structure 10 of the invention includes four mounting strips, 11, 12, 13, 14, attached to a flexible carrier 15 provided therefor.

The mounting strips are preferably formed of two-sided adhesive material, such as plastic strips having adhesive coats on both surfaces thereof, for example. The flexible carrier may itself be formed of plastic, vinyl, or other flexible material.

Figure 2:
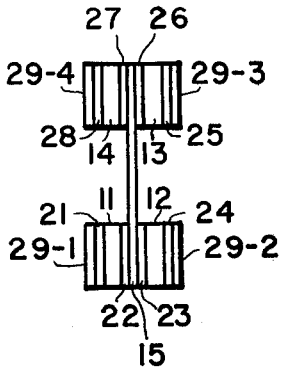
FIG. 2 shows a detailed end view of the mounting frame structure of FIG. 1.

As shown in greater detail in FIG. 2, mounting strip 11 includes an adhesive layer 21 at one end thereof and a second adhesive layer 22 at its other end. Similarly, mounting strip 12 includes an adhesive layer 23 at its one end and a further adhesive layer 24 at its other end. Similarly, mounting strip 13, includes an adhesive layer 25 at one end and a further adhesive layer 26 at its other end, while mounting strip 14 includes an adhesive layer 27 at one end and a further adhesive layer 28 at its other end.

Mounting strips 11, 12, 13 and 14 are mounted by adhesive layers 22, 23, 26 and 27 to the flexible carrier 15. For protection of the remaining adhesive layers 21, 24, 25 and 28, an adhesive protective material including a release layer, for example, is provided for each of the mounting strips. Protector strips 29-1, 29-2, 29-3 and 29-4 are provided for mounting strips 11-14, respectively. Thus, the complete frame structure may be formed of elongated strips of the flexible carrier 15 having mounted thereon four mounting strips of a two-sided adhesive variety, each of the strips being protected by the adhesive protective material on a protector strip.

In accordance with the invention, the frame structure shown in FIGS. 1 and 2 is utilized to mount an insulating sheet to a surface surrounding a thermal opening. For purposes of this description, a thermal opening refers to an actual breach in a structure, such as a vent or other opening therein permitting passage of drafts and the like. Alternatively, the term thermal opening may further refer to specified closed portions of a structure permitting either drafts or heat to pass therethrough, such as windows and doors, for example.

Figure 3:
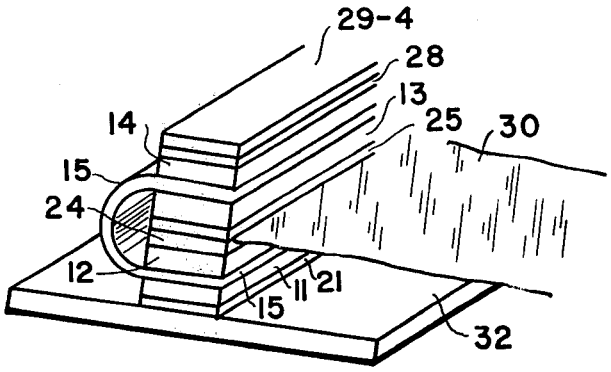
FIG. 3 shows an application of the mounting frame structure to an insulating sheet in accordance with the principles of the invention.
Figure 4:
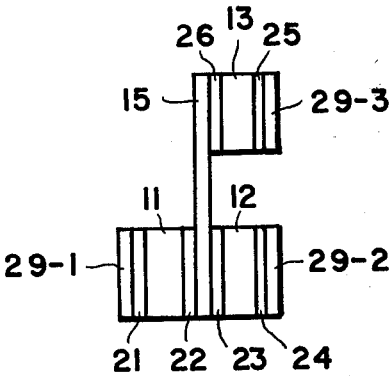
FIG. 4 provides an end view of an alternate embodiment of the inventive frame structure shown in FIG. 1.

Practice of the invention requires attachment of the mounting frame structure to the stable structure surrounding the thermal opening. For purposes of this disclosure, by "stable structure" is meant a wall, a window- or door-frame, a window sash, a door jamb, or the like. As shown at FIG. 3, one edge of an insulating sheet 30 may be attached to a stable structure 32 by means of the mounting frame shown in FIG. 1. Specifically, the mounting frame is attached to stable structure 32, hereinafter referred to as a wall, by adhesive action of layer 21 after removal of its protective strip 29-1. Subsequent to removal of the protective strip 29-2, the insulating sheet 30 is adhesively conded to mounting strip 12 by adhesive action of layer 24. It should be noted that at this time the insulating sheet is effectively mounted on the wall adjacent the thermal opening. Further, it is noted that the mounting between the insulating sheet 30 and the wall is sealed by mounting strips 11 and 12. However, at this point sheet 30 is only connected to the mounting frame at only one of its surfaces. Such a connection may be improved upon by adhesively bonding the other surface of the insulating sheet to mounting strip 13. Accordingly, the adhesive protective strip 29-3 is removed from strip 13 and the flexible carrier 15 bent in a U-shape to provide engagement between adhesive layer 25 of mounting strip 13 and the other surface of insulating sheet 30. Manual applied pressure may be used to enhance the adhesion among the various layers and surfaces.

A further advantage of the present invention is now apparent. Specifically, the bent over portion of flexible carrier 15 provides yet a further dead airspace for insulating the interior of the dwelling from the effects of the thermal opening. It is to be understood that preferably the insulating sheet is mounted along its entire periphery to the wall, so that a double seal is provided by the action of mounting strips 11 and 12 on the one hand and of the U-shaped flexible carrier 15 on the other hand.

Figure 6:
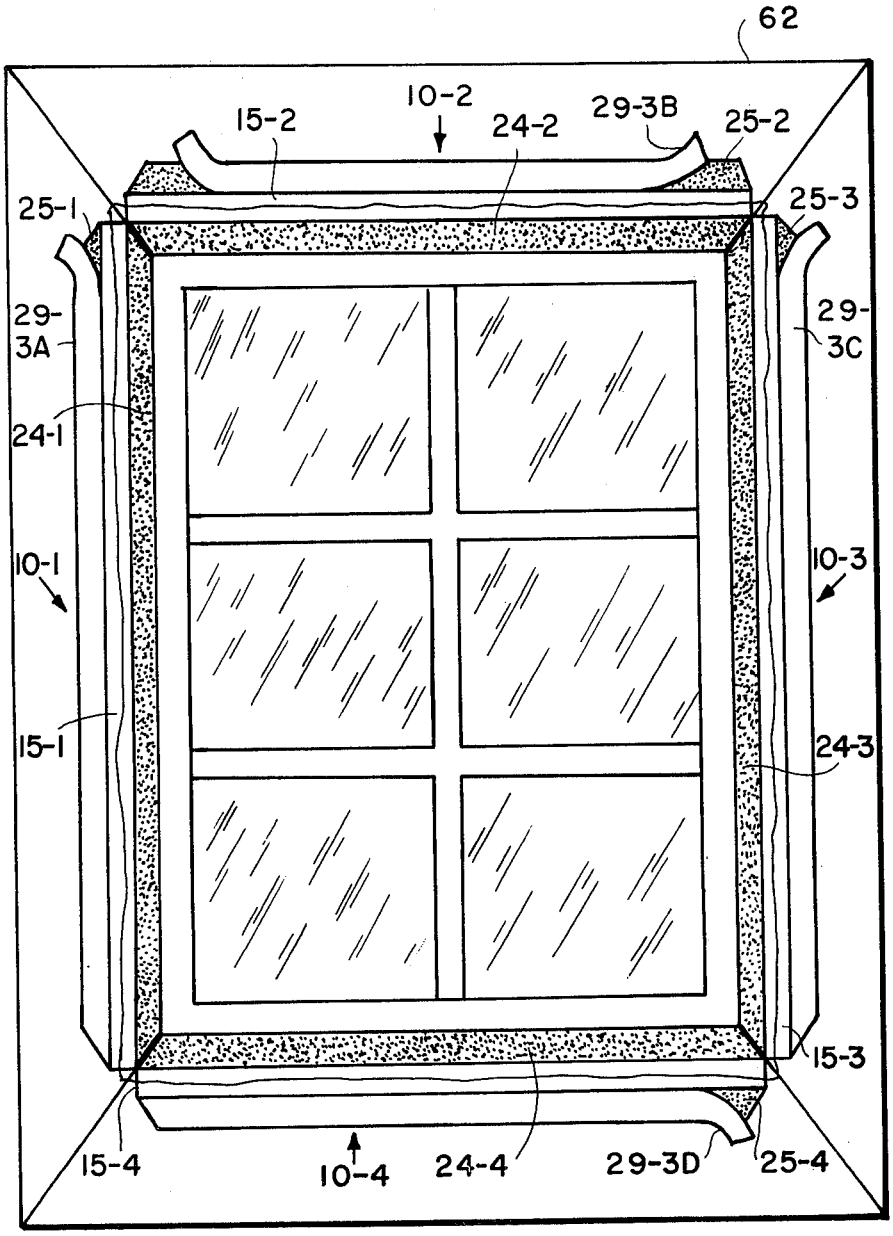
FIG. 6 shows the present invention as applied to a window.

In typical applications of the invention to windows in residential structures, for example, the insulating sheet 30 is rectangular and has four edges. Each of the edges is mounted to the stable structure by an appropriately dimensioned mounting frame structure as shown in FIG. 6. The ends of flexible carrier 15 may thus be appropriately shaped, or may be properly cut, to provide a substantially continuous dead airspace surrounding the entire insulating sheet and enhancing operation of the system.

With reference to mounting strip 14, it is noted that this strip is optional, and may be omitted from the inventive structure. However, preferably the strip permits the mounting of still a second insulating sheet (not shown) to the structure illustrated at FIG. 3. This may be done by removal of adhesive protective strip 29-4 and by mounting the second insulating sheet to the now exposed adhesive layer 28. Alternatively, a second mounting frame may be attached to mounting strip 14 which serves as a stable structure, and the second insulating sheet mounted thereby.

An additional advantage of the presence of mounting strip 14 is the extended utility provided to the inventive structure. For example, where it is not desired to remove the mounting frame structure at the end of a heating season, insulating sheet 30 may be easily trimmed at its connection to mounting strips 12 and 13. In the next season in which insulation of the thermal opening is desired, a second insulating sheet may be attached to mounting strip 14 as hereinabove described.

Figure 5:
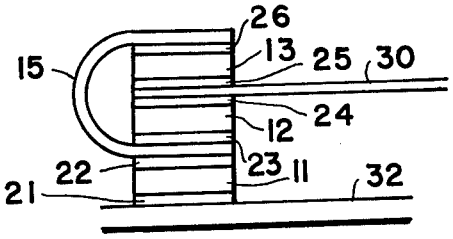
FIG. 5 shows an application of the alternate embodiment to an insulating sheet.

An end view of the alternative embodiment of the mounting frame as hereinabove described is shown at FIG. 5, wherein a mounting frame structure having three mounting strips is shown. Therein, mounting strips 11, 12 and 13 are attached to a flexible carrier 15, but a fourth mounting strip is not provided. Application of the alternate embodiment is illustrated in FIG. 5, wherein mounting strip 1 is seen to be adhesively bonded to wall 32 by adhesive layer 21. Flexible carrier 15 is bonded to mounting strip 11 by adhesive layer 22, and in turn bonded at its other surface to mounting strip 12 by adhesive layer 23. Insulating sheet 30 is mounted between mounting strip 12 and 13 by action of adhesive layers 24 and 25 respectively. Finally, flexible carrier 15 is adhesively bonded to mounting strip 13 by adhesive layer 26, thus forming a seal for the inventive structure by dead airspace 34.

Referring now to FIG. 6, the inventive apparatus is shown as applied to a window frame. As shown therein, four mounting frame structures 10-1, 10-2, 10-3 and 10-4 are used to attach insulating sheet 30 to window frame 62. Adhesive layers 24-1, 24-2, 24-3 and 24-4 adhere sheet 30 to their underlying mounting strips. Removal of adhesive protective material strips 29-3A, 29-3B, 29-3C and 29-3D exposes adhesive layers 25-1, 25-2, 25-3 and 25-4, respectively.

Folding mounting frame structures 10-1, 10-2, 10-3 and 10-4 in accordance with the previous description and the illustrations in FIGS. 3 and 5 above causes adhesive layers 25-1 through 25-4 to bond to the interior surface of insulating sheet 30, thus providing an enhanced mount therefor and completing a seal around the mounted insulating sheet.

It is thus noted that the present invention provides mounting structure for an insulating sheet for use adjacent any thermal opening, whether in an automotive vehicle, a domestic residence, an industrial application or the like. Advantageously, the invention provides for direct attachment of the insulating sheet to the mounting frame, rather than mere engagement thereof as suggested in some prior art devices. A simplified mounting structure is provided, having a plurality of two-sided adhesive strips, and a flexible carrier for the strips is further used to provide a seal for the insulation.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, the number of mounting strips may be changed. The embodiment disclosed in the specification was chosen and described in order best to explain the principles of the invention and its practical application, thereby to enable others skilled in the art to utilize the invention in various embodiments and with various modifications as are suited to the particular use contemplated. It is intended that the scope of the invention be defined by the claims appended hereto.

I claim:

1. An insulating structure comprising:

a mounting frame for attachment to a stable structure adjacent a thermal opening, and an insulating sheet for mounting on said mounting frame, said mounting frame comprising first and second mounting strips each having two oppositely disposed adhesive surfaces, said first mounting strip having a first adhesive surface for adhering said mounting frame to said stable structure and an oppositely disposed adhesive surface for connecting to said second mounting strip, said second mounting strip having first and second adhesive mounting means for attachably mounting a portion of one surface of said insulating sheet to said stable structure.

2. An insulating structure as recited in claim 1 wherein said second mounting strip is arranged for connecting along one adhesive surface thereof to said first mounting strip and for adhering along an oppositely disposed adhesive surface thereof to said one surface of said insulating sheet.

3. An insulating structure comprising:

a mounting frame for attachment to a stable structure adjacent a thermal opening, and an insulating sheet for mounting on said mounting frame, said mounting frame comprising first and second mounting strips each having at least one adhesive surface, at least one of said mounting strips having two oppositely disposed adhesive surfaces, said first mounting strip having first mounting means for mounting said mounting frame to said stable structure, said second mounting strip having second mounting means for attachably mounting a portion of one surface of said insulating sheet to said stable structure, said second mounting strip arranged for connecting along one adhesive surface thereof to an adhesive surface of said first mounting strip and for adhering along an oppositely disposed adhesive surface thereof to said one surface of said insulating sheet, and flexible support means for said first and second mounting strips interposed between said one adhesive surface of said second mounting strip and said adhesive surface of said first mounting strip, said flexible support means having a first surface for connection to said first mounting strip and a second surface for connection to said second mounting strip.

4. An insulating structure as recited in claim 3 further comprising a third mounting strip having two oppositely disposed adhesive surfaces, and further having a third mounting means for mounting to a portion of an opposing surface of said insulating sheet.

said third mounting strip being arranged for adhering along one adhesive surface thereof to said opposing surface of said insulating sheet.

5. An insulating structure as recited in claim 4 further comprising a fourth mounting strip attached to said third mounting strip for mounting a second insulating sheet to the mounting frame.

6. An insulating structure as recited in claim 3 wherein said flexible support means is adhesively bonded to said first and second mounting strips.

7. An insulating structure as recited in claim 6 further comprising a third mounting strip having two oppositely disposed adhesive surfaces, said third mounting strip further having third mounting means for mounting to a portion of an opposing surface of said insulating sheet and to said flexible support means, said third mounting strip being arranged for attaching along one adhesive surface thereof to said opposing surface of said insulating sheet and being adhesively bonded along its other adhesive surface to said second surface of said flexible support means, whereby said flexible support means forms a seal for the insulating structure.

8. An insulating structure as recited in claim 7 further comprising a fourth mounting strip having two oppositely disposed adhesive surfaces, one of said adhesive surfaces being adhesively bonded to said first surface of said flexible support means.

9. Support structure for interior insulators comprising:

first mounting means for mounting said support structure to a stable structure;

second mounting means connected to said first mounting means for attachably mounting a portion of one surface of an interior insulator to said stable structure;

third mounting means for attaching to a corresponding portion of an opposing surface of said interior insulator and for enhancing the attachment of said interior insulator to said second mounting means, said first, second and third mounting means each comprising a mounting strip having two oppositely disposed surfaces and an adhesive coating on both of said surfaces.

10. Support structure for interior insulators comprising:

first mounting means for mounting said support structure to a stable structure;

second mounting means connected to said first mounting means for attachably mounting a portion of one surface of an interior insulator to said stable structure;

third mounting means for attaching to a corresponding portion of an opposing surface of said interior insulator and for enhancing the attachment of said interior insulator to said second mounting means, said first, second and third mounting means each comprising a mounting strip having two oppositely disposed surfaces and an adhesive coating on both of said surfaces, said first mounting strip arranged for adhering along one adhesively coated surface thereof to said stable structure and for attaching along the other adhesively coated surface thereof to said second mounting strip;

said second mounting strip arranged for attaching along one adhesively coated surface thereof to said first mounting strip and for adhering along the other adhesively coated surface thereof to said one surface of said interior insulator;

said third mounting strip arranged for attaching along one adhesively coated surface thereof to the opposing surface of said interior insulator, and flexible support means for said first and second mounting strips, said support means having first and second surfaces and being interposed between said other surface of said first mounting strip and said one surface of said second mounting strip, said first and second surfaces thereof being adhesively bonded to said first and second mounting strips.

11. Support structure as recited in claim 10 further comprising fourth mounting means attached to said third mounting means for mounting a second interior insulator thereto.

12. Support structure as recited in claim 10 wherein said third mounting means is connected to said first and second mounting means.

13. Support structure as recited in claim 10 wherein said third mounting means is adhesively bonded along its other surface to said support means.

14. Support structure as recited in claim 13 further comprising a fourth mounting strip having two oppositely disposed surfaces each having an adhesive coated thereon, one of said surfaces of said fourth mounting strip being adhesively bonded to said first surface of said flexible support means.

15. A method for installing an interior insulator to a structure, the insulator including an insulating sheet and a mounting frame therefor, the mounting frame including a plurality of mounting strips having oppositely disposed adhesive surfaces and a flexible support means, a first and a second of said mounting strips being adhesively bonded at respective first surfaces thereof to first and second opposing surfaces of the flexible support means, a third mounting strip having oppositely disposed adhesive surfaces, comprising the steps of:

adhesively bonding a second surface of said first mounting strip to a stable structure, adhesively bonding a first surface of said insulating sheet to a second surface of said second mounting strip, adhesively bonding a first surface of said third mounting strip to said second surface of said flexible support means, and adhesively bonding a second surface of said third means to a second surface of said insulating sheet.

16. A method as recited in claim 15 wherein said mounting frame includes a fourth mounting strip having oppositely disposed adhesive surfaces adhesively bonded at a first surface thereof to said first surface of said flexible support means.

17. A method as recited in claim 16 comprising the further step of mounting an additional insulator to the interior insulator by adhesively bonding said additional insulator to a second surface of said fourth mounting strip.

18. A method as recited in claim 15 comprising the further step of forming a seal for the interior insulator by folding said flexible support means to provide a dead airspace at the periphery of the interior insulator.

* * * * *